United States Patent [19]

Fullerton

[11] Patent Number: 5,016,814

[45] Date of Patent: May 21, 1991

[54] COLLAPSIBLE BOX WITH IMPROVED CORNER LOCKS

[76] Inventor: James T. Fullerton, P.O. Box 8158, Valley, Ala. 36872

[21] Appl. No.: 584,699

[22] Filed: Sep. 19, 1990

[51] Int. Cl.[5] ..... B65D 5/30

[52] U.S. Cl. ..... 229/196; 229/195

[58] Field of Search ..... 229/190, 191, 195, 196

[56] References Cited

U.S. PATENT DOCUMENTS

| | | | |
|---|---|---|---|
| 363,143 | 5/1887 | Huston | 229/190 |
| 1,383,714 | 7/1921 | Freund | 229/190 |
| 2,147,676 | 2/1939 | Shoemaker | 229/196 |
| 2,394,850 | 2/1946 | Evans | 229/190 |
| 2,404,916 | 7/1946 | Meller | 229/195 |
| 2,476,253 | 7/1949 | Van Rosen | 229/196 |
| 3,093,291 | 6/1963 | Brandle | 229/196 |
| 3,682,369 | 8/1972 | Isakson | 229/195 |

FOREIGN PATENT DOCUMENTS

| | | | |
|---|---|---|---|
| 578784 | 10/1924 | France | 229/195 |
| 151 | of 1898 | United Kingdom | 229/195 |

*Primary Examiner*—Gary E. Elkins

*Attorney, Agent, or Firm*—Kennedy & Kennedy

[57] ABSTRACT

A collapsible box is formed from a cardboard blank. The box has a bottom panel, a pair of parallel side panels and a pair of parallel end panels. Each end panel has a pair of wing panels formed with slots for interlocking engagement with corner tongue portions of the side panels.

3 Claims, 3 Drawing Sheets

COLLAPSIBLE BOX WITH IMPROVED CORNER LOCKS

TECHNICAL FIELD

This invention relates to boxes and cartons of the type that may be erected from cardboard blanks with their corners mechanically interlocked.

BACKGROUND OF THE INVENTION

Boxes and cartons used for the packaging, shipment, and storage of articles of commerce are often constructed to be erectable from and collapsible to flat configurations. These types of boxes are typically constructed from cardboard blanks that have score lines along which the sides of the boxes may be folded about their bottoms. Some of them have their sides bonded in place with sealing agents and adhesives. These types however take prolonged time to construct due to the time required for the adhesive to set. Also, once that type of box or carton is constructed it can not be disassembled and returned to a flat blank configuration for storage and reuse.

Cartons and boxes made from cardboard blanks have also long been devised which have their sides held uprightly by means of interfitting tabs and slots which avoid the need for adhesives. These corner-lock type boxes typically are configured from cardboard blanks that have side corner retention means in the form of extended portions or tongues that may be extended through slits. Exemplary of such is the one shown in U.S. Pat. No. 4,216,897. These types of corner locks however can have substantial forces exerted upon them thus causing material stress and deformation. With prolonged use and repeated assemblies and disassemblies, the tongues and slits can deform, enlarge and rip. Another problem associated with these type boxes is their limited ability to support other loaded boxes stacked one upon another without crinkling their walls.

It thus is seen that a collapsible box erectable from a blank with corner-locking means and with the ability of supporting other boxes without substantially weakening has long remained an elusive goal. Accordingly, it is to the provision of such a box that the present invention is primarily directed.

SUMMARY OF THE INVENTION

In a preferred form of the invention a box adapted to be erected from a cardboard blank comprises a bottom panel having two side panels hingedly connected to the bottom panel along bottom side folds with each side panel having a top edge located distally from a bottom side fold and connected thereto by a pair of side edges. Each side panel has a pair of notches extending from its top edge adjacent to a pair of side edges to define a pair of corner tongues between the side edges and notches. Two end panels are also hingedly connected to the bottom panel along bottom end folds. Each end panel has a central section straddled by a pair of wing flaps hingedly connected to the central section along wing folds. Each of the wing flaps has an inner wing flap section located adjacent the central section and an outer wing flap section hingedly connected to the inner wing flap section along a dihedral fold. Each wing flap also has a slot sized and positioned to receive one of the corner tongues for interlocking engagement with it. During box erection the corner tongues may be inserted through the wing flaps slots and interlocked between the end panel central sections and the wing flaps dihedral folds to prevent the box from collapsing by limiting movement of the end panels with respect to the side panels.

DETAILED DESCRIPTION

Figure 1:
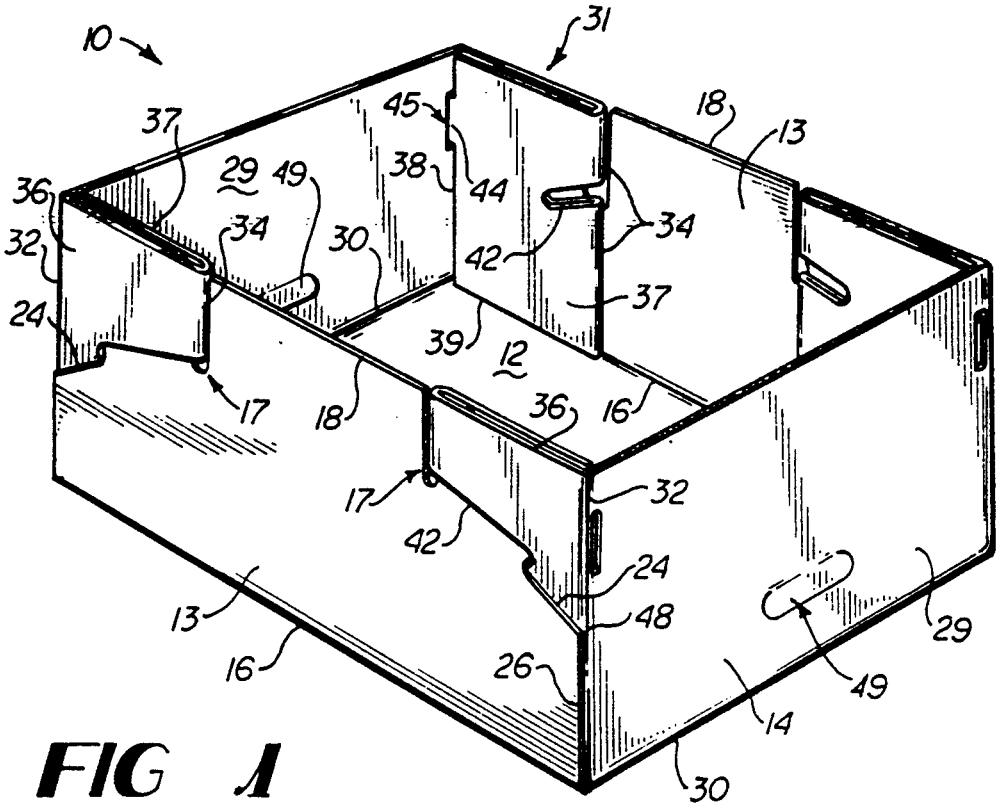
FIG. 1 is a perspective view of a box embodying principles of the present invention in a preferred form.
Figure 3:
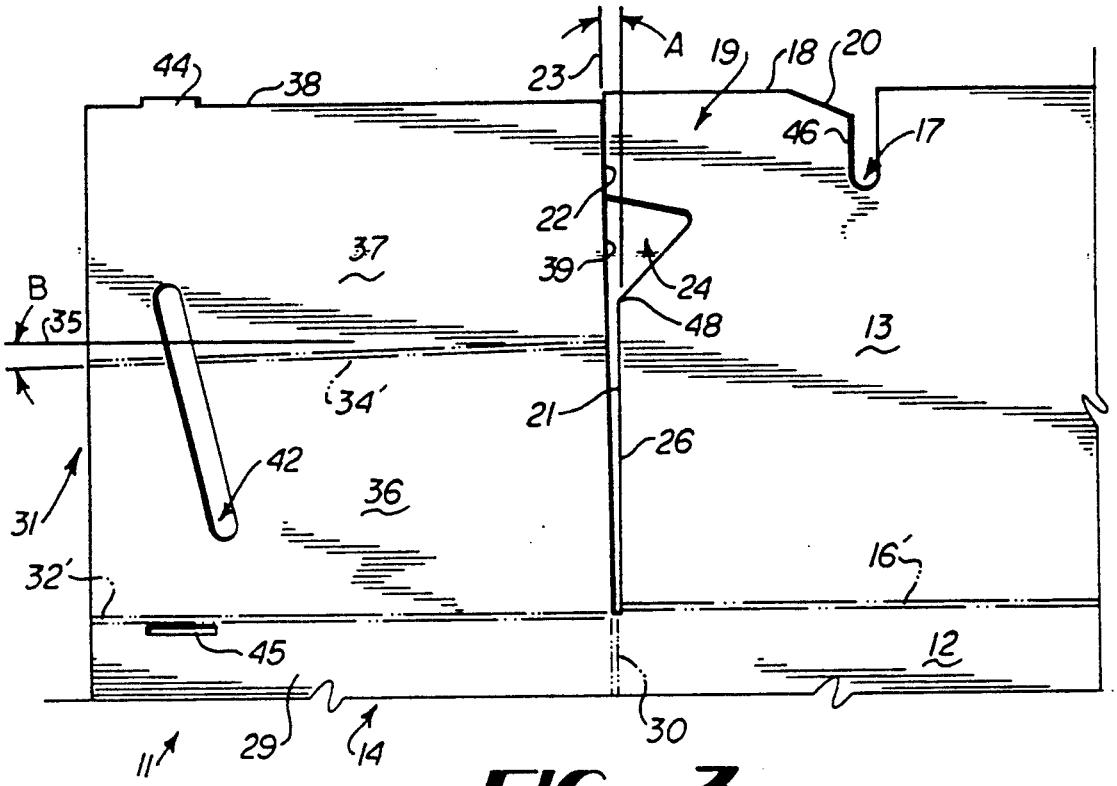
FIG. 3 is a plan view of a corner portion of the box of FIG. 1 shown in a flat, unassembled configuration.
Figure 5:
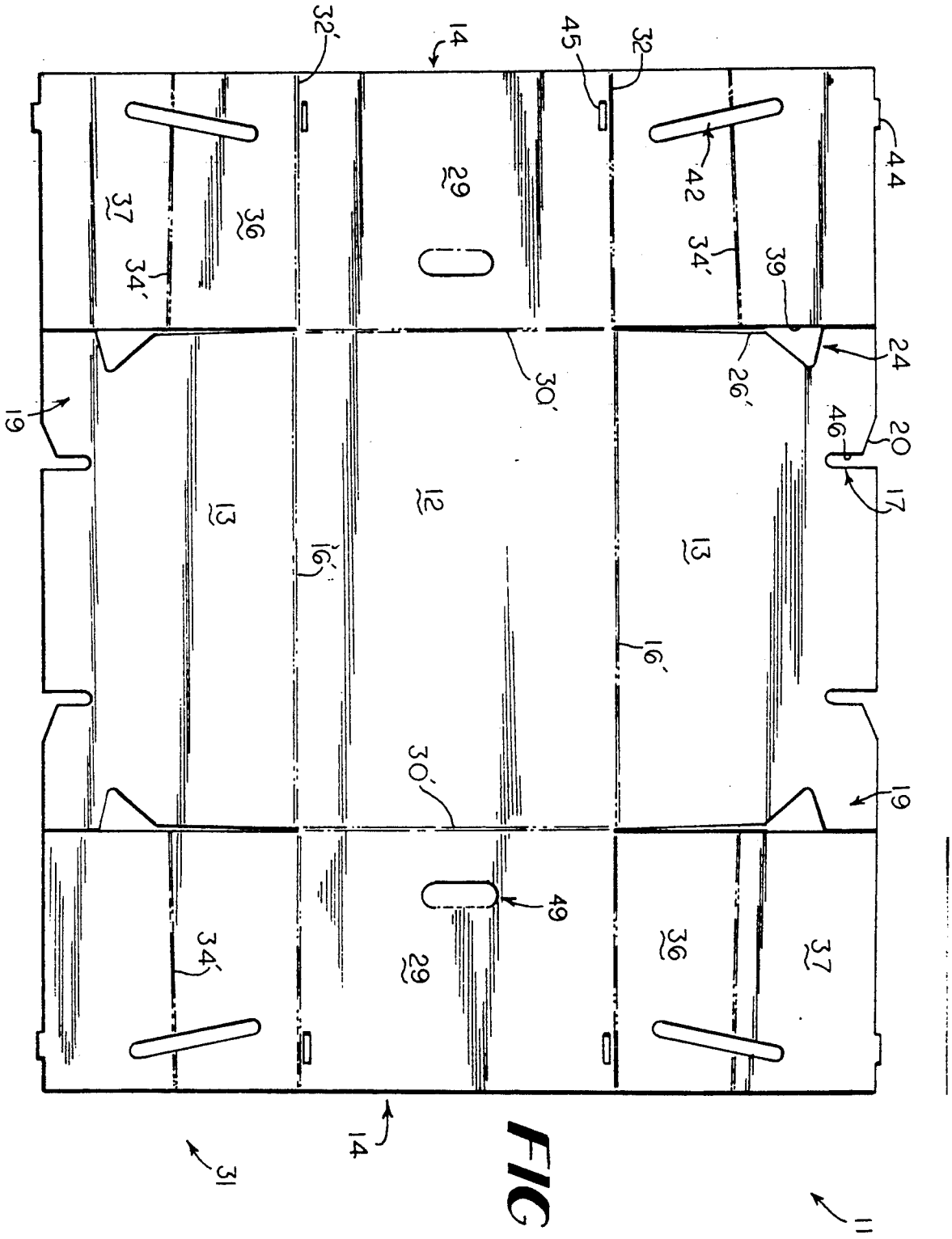
FIG. 5 is a plan view of the complete blank from which the box of FIG. 1 is formed.

With reference next to the drawing, in FIG. 1 there is shown a box 10 embodying principles of the invention. The box 10 is formed from the flat blank 11 shown in FIG. 5, that preferably is made of conventional corrugated cardboard. The box has a bottom panel 12, a pair of parallel side panels 13, and a pair of parallel end panels 14. The side panels 13 are hingedly connected to the bottom panel 12 along two parallel bottom side folds 16 conventionally provided by score lines 16' and are formed with hand grip slots 49. The side panels 13 are formed with interlock notches 17 that extend from the side panel top edges 18 to define corner tongues 19. The notches are partially defined by an oblique bearing edge 20. As best shown in FIG. 3, the side edges 21 of the side panel have a portion 22 that extends normally from top edge 18 to a generally V-shaped notch 24 and a second linear portion 26 that extends from the notch 24 to fold 16 at a slight angle with respect to the first portion 22.

The end panels 14 each have a central section 29 hingedly connected to the bottom panel 12 along end folds 30 provided by score lines 30'. Each central section 29 is straddled by a pair of wing flaps 31 hingedly connected to the central section along wing folds 32 defined by score lines 32'. With the box in an erected configuration the wing folds 32 are oriented perpendicular to adjacent bottom side folds 16 and adjacent end folds 30. However, with the box in its flat blank configuration, the wing folds 32 are oriented parallel to adjacent bottom side folds 16 and laterally offset from them by a space equal to the width of the cardboard stock.

Each wing flap 31 is substantially bisected by a dihedral fold 34 defined by score line 34' which divides the flap into an inner wing flap section 36 and an outer wing flap section 37. The dihedral folds 34 are oriented at a slight acute angle B with a line 35 oriented parallel to wing fold 32, as shown in FIG. 3. Each wing flap is formed with an elongated slot 42 sized and positioned to receive a corner tongue 19 for interlocking engagement as the box is erected. These slots 42 extend across the dihedral folds 34. Outer wing flap side edges 38 have tabs 44 located for insertion into tab slots 45 formed in the central section 29 closely adjacent folds 32.

Figure 2A:
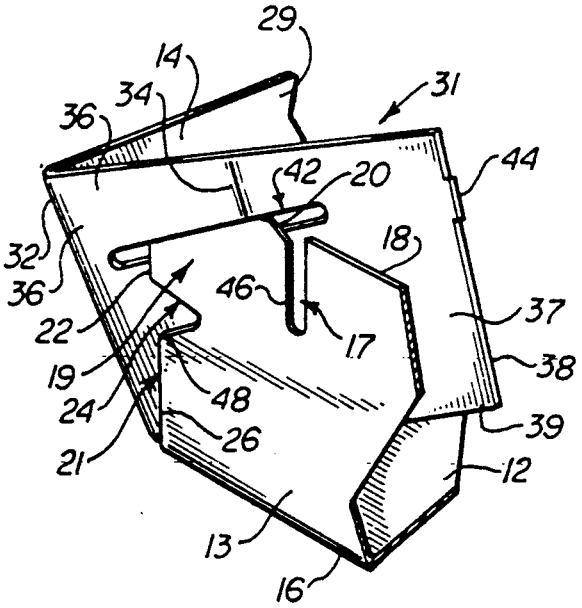
FIGS. 2A and 2B are perspective views of a corner portion of the box of FIG. 1 shown in successive stages of assembly.

Box 10 is erected from the flat blank 11 which, for enhanced strength, is formed with its corrugations extending parallel to the score lines 32. The box is erected by folding the side panels 13 perpendicularly to the bottom panel 12 along the bottom side folds 16. The end panels 14 are then folded along bottom end folds 30 towards the side panels 13. As this is done the corner tongues 19 of the side panels 13 are inserted through the wing flaps slots 42, as shown in FIG. 2A, to bring a portion of dihedral fold 34 in a position overlaying edge 46 of side notch 17. As the slots 42 extend across the dihedral folds 34 ample clearance is provided for the corner tongues 19 and yet close proximity to the notches corner tongue defining edge 46.

Figure 2B:
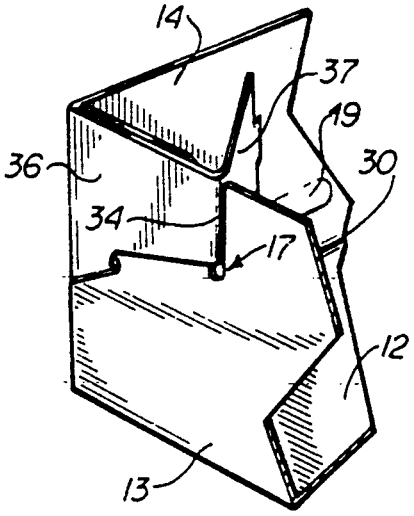

The outer wing flap sections 37 are then folded along the dihedral folds 34, as shown in FIG. 2B, until they are flush against the inner wing flap sections 34, except where the two wing flaps section sandwich the corner tongues 19. In this manner the corner tongues 19 are captured in an interlocked position by the end panel wings between the wing fold 32 and dihedral fold 34 thereby limiting movement of the end panels relative to the side panels. The oblique angle B of the dihedral fold 34 with line 35 causes the outer wing flap section bottom edges 39 to jam against the bottom panel 12 as the outer wing flap sections are folded into place thereby holding them firmly in place sandwiching the corner tongues. The outer wing flap sections 35 are additionally held in place by being inserted into the tab slots 45. Box 10 can be returned to its blank configuration for storage by simply reversing the process of assembly just described without significant degradation.

The box can well support others in a stack. One reason for its strength in this regard is that each of the box corners is made up of four sections of cardboard, namely the end panel central section 29, the inner wing flap section 36, the outer wing flap section 37 and the side panel 13. Another reason for its strength is that the first three sections just listed have their parallel corrugations aligned substantially vertical. Also, the second notches 24 enable the wing flap slots 42 to be spaced from the wing folds 32 for strength of construction.

The box is also able to maintain its structural integrity through many erections and collapses because of its relatively few number of folds. Another reason for this is that each fold extends from one edge to another thereby assuring that the fold does not progress further than designed. The only portions of the box that need be bowed slightly to produce an interlocking corner are the corner tongues 19. Finally, as the side panels tapering side edges 26 are formed at an acute angle with the corner tongue side edge 22, as shown in FIG. 3, a top or cover may be easily fitted upon the box. Here the side panels side edges 21 are oriented at a slight acute angle A with the bottom side fold 16. With this the outer wing flap section bottom edges 39 may be further jammed against the bottom panel 12 as the box is erected. Also, the edges 21 of each side panel 13 are oriented at an acute angle with each other. Thus when the box is in an erected configuration the end panels 14 are oriented at an acute angle with each other to facilitate the mounting of a cover.

Figure 4:
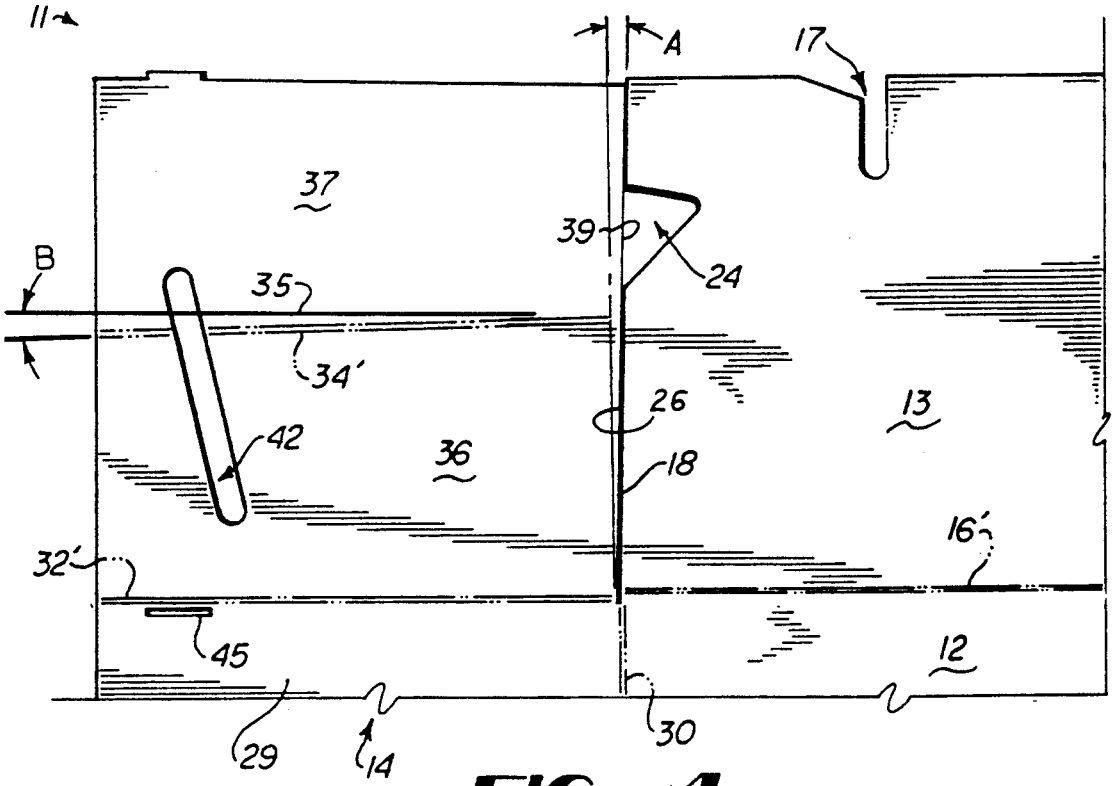
FIG. 4 is a plan view of a corner portion of a box shown in a flat, unassembled configuration of an alternative form.

As shown in FIG. 4 the side edge portion 22 may be coextensive with the second portion 26 and oriented at a slight angle A with respect to normal line 23. This configuration provides for additional side edge support against wing fold 32 when the box is in an erected configuration. Also, this orientation of the wing flap section bottom edges 39 causes additional jamming of the bottom edge to that produced by angle B.

From the foregoing, it is seen that a collapsible box is now provided with improved corner locks. It should however be understood that the just described embodiments merely illustrates principles of the invention in preferred forms. It should also be understood that a box with as few as even a single corner lock of the type described would embody the invention. Thus, many modifications, additions and deletions may be made to these specific examples without departure from the spirit and scope of the invention as set forth in the following claims.

I claim:

1. A box adapted to be erected from a cardboard blank comprising a bottom panel; two side panels hingedly connected to said bottom panel along bottom side folds with each of said side panels having a top edge located distally from said bottom side fold and connected thereto by a pair of side edges, each of said side panels having a pair of notches extending from said top edge adjacent to said pair of side edges to define a pair of corner tongues between said side edges and notches; two end panels each having a central section hingedly connected to said bottom panel along bottom end folds and with each of said end panels central sections straddled by a pair of substantially rectangular wing flaps hingedly connected to said central section along wing folds, each of said wing flaps having an inner wing flap section located adjacent said central section and an outer wing flap section hingedly connected to said inner wing flap section along a dihedral fold, each said dihedral fold is oriented obliquely to said wing fold, each of said wing flaps also having a wing flap slot sized and positioned to receive one of said corner tongues for interlocking engagement therewith, whereby during box erection the corner tongues may be inserted through the wing flaps slots and interlocked between the end panel central sections and the wing flaps dihedral folds thereby preventing the box from collapsing by limiting movement of the end panels with respect to the side panels, and whereby during box erection the angle of the dihedral fold causes the outer wing flap to jam against the bottom panel as the outer wing flap is folded.

2. A box adapted to be erected from a cardboard blank comprising a bottom panel; two side panels hingedly connected to said bottom panel along bottom side folds with each of said side panels having a top edge located distally from said bottom side fold and connected thereto by a pair of side edges, each of said side panels having a pair of notches extending from said top edge adjacent to said pair of side edges to define a pair of corner tongues between said side edges and notches; two end panels each having a central section hingedly connected to said bottom panel along bottom end folds and with each of said end panels central sections straddled by a pair of wing flaps hingedly connected to said central section along wing folds, each of said wing flaps having an inner wing flap section located adjacent said central section and an outer wing flap section hingedly connected to said inner wing flap section along a dihedral fold, each of said wing flaps also having a wing flaps slot which extends across said dihedral wing fold, said wing flaps slot is sized and positioned to receive one of said corner tongues for interlocking engagement therewith, whereby during box erection the corner tongues may be inserted through the wing flaps slots and interlocked between the end panel central sections and the wing flaps dihedral folds thereby preventing the box from collapsing by limiting movement of the end panels with respect to the side panels.

3. A cardboard box having a bottom panel from which at least one side panel and one end panel extend to form a box corner, said end panel having a central section hingedly connected to said bottom panel to which a wing flap section is hinged along a wing fold, said wing flap section being formed with a dihedral fold oriented substantially parallel to said wing fold and a wing flap slot extending across said dihedral fold, and wherein said side panel has a corner tongue that extends through said wing flap slot and said wing flap section is folded along said dihedral fold about said side panel corner tongue thereby releasibly capturing said side panel corner tongue between said end panel wind flap dihedral fold and said wing fold.

* * * * *